US010452006B2

(12) United States Patent
Hashimoto et al.

(10) Patent No.: US 10,452,006 B2
(45) Date of Patent: Oct. 22, 2019

(54) FIXING DEVICE AND IMAGE FORMING APPARATUS THAT RESTORE A GUIDING MEMBER FROM A RETRACTED POSITION TO A GUIDING POSITION WHEN A COVER CLOSES

(71) Applicant: CANON KABUSHIKI KAISHA, Tokyo (JP)

(72) Inventors: Naoki Hashimoto, Kashiwa (JP); Shutaro Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/906,512

(22) Filed: Feb. 27, 2018

(65) Prior Publication Data

US 2018/0253047 A1 Sep. 6, 2018

(30) Foreign Application Priority Data

Mar. 1, 2017 (JP) ..... 2017-038182
Dec. 28, 2017 (JP) ..... 2017-252970

(51) Int. Cl.
*G03G 15/20* (2006.01)
*G03G 21/16* (2006.01)

(52) U.S. Cl.
CPC ..... *G03G 15/2028* (2013.01); *G03G 15/2017* (2013.01); *G03G 15/2032* (2013.01); *G03G 21/1685* (2013.01); *G03G 21/1633* (2013.01); *G03G 2221/1639* (2013.01)

(58) Field of Classification Search
CPC ..... G03G 15/2028; G03G 15/2085; G03G 15/2017
See application file for complete search history.

(56) References Cited

U.S. PATENT DOCUMENTS

| | | | | |
|---|---|---|---|---|
| 8,620,183 | B2 * | 12/2013 | Hosoi | B65H 5/38 399/124 |
| 8,779,335 | B2 | 7/2014 | Saito | |
| 8,958,716 | B2 | 2/2015 | Saito | |
| 9,020,407 | B2 | 4/2015 | Hashimoto | |
| 9,389,554 | B2 | 7/2016 | Tanaka et al. | |
| 9,465,336 | B2 | 10/2016 | Saito et al. | |
| 9,563,163 | B2 | 2/2017 | Tanaka et al. | |
| 2014/0153938 | A1 | 6/2014 | Saito | |

FOREIGN PATENT DOCUMENTS

| | | | | |
|---|---|---|---|---|
| JP | 2011-022536 A | | 2/2011 | |
| JP | 2014170117 A | * | 9/2014 | G03G 21/1633 |

* cited by examiner

*Primary Examiner* — Erika J Villaluna
(74) *Attorney, Agent, or Firm* — Venable LLP

(57) ABSTRACT

A fixing device includes a first unit including a first rotatable member, a second unit including a second rotatable member forming a nip with the first rotatable member, for fixing a toner image on a recording material, and a frame supporting the second unit. A guiding member is movable between a guiding position for guiding the recording material toward the nip, and a retracted position in which the guiding member is retracted from a space permitting demounting of the second unit from the frame. A cover member is openable to an open position for exposing the space, and is configured to move to a closed position, and an interrelating mechanism is configured to restore the guiding member, in the retracted position when the cover member is in the open position, to the guiding position in interrelation with movement of the cover member from the open position to the closed position.

20 Claims, 4 Drawing Sheets

FIXING DEVICE AND IMAGE FORMING APPARATUS THAT RESTORE A GUIDING MEMBER FROM A RETRACTED POSITION TO A GUIDING POSITION WHEN A COVER CLOSES

This application claims the benefit of Japanese Patent Application No. 2017-038182, filed on Mar. 1, 2017, and No. 2017-252970, filed on Dec. 28, 2017, which are hereby incorporated by reference herein in their entireties.

FIELD OF THE INVENTION AND RELATED ART

The present invention relates to a fixing device and an image forming apparatus and is applied to a copying machine, a printer, a facsimile machine, and the like, that employ an electrophotographic type image forming apparatus, for example.

As regards a roller used in the fixing device, a durable lifetime is determined, and, therefore, is periodically exchanged by a service person. In such a fixing device, in addition to improvement of productivity and of an image quality, improvement of an exchange operativity of a component by the service person is desired.

In the fixing device, as a guiding member for guiding a recording material to a nip, a fixing (device) entrance guide is provided upstream of the nip with respect to a recording material feeding direction in some cases. As regards this fixing entrance guide, in order to stably guide the recording material into the nip, a free end of the fixing entrance guide on the nip side may preferably be close to the nip.

When the free end of the fixing entrance guide is close to the nip, however, a locus drawn when a pressing roller or a pressing unit is exchanged with a new article crosses the fixing entrance guide, so that the exchange of the pressing roller is obstructed.

Therefore, in order to avoid interference between the fixing entrance guide and the pressing unit, in Japanese Laid-Open Patent Application No. 2011-22536, when the pressing unit is demounted from a frame, the fixing entrance guide is retracted so as not to overlap with the pressing unit in a projection region of a rotatable pressing member. Then, when the pressing unit is returned to an original position, in order to prevent forgetfulness to close the fixing entrance guide (i.e., forgetfulness to set the position of the fixing entrance guide from a retracted position to an original installation position), a mechanism for detecting the position of the fixing entrance guide by a photosensor is provided.

In the above-described prior art, however, there is a problem such that the number of components increases and a cost becomes high, and that adjustment also becomes complicated.

SUMMARY OF THE INVENTION

A principal object of the present invention is to provide a fixing device and an image forming apparatus that are capable of inexpensively and easily achieving prevention of forgetfulness to return a position of a guiding member from a retracted position to a guiding position.

According to one aspect, the preset invention provides a fixing device comprising a first unit including a first rotatable member, a second unit including a second rotatable member forming a nip, in cooperation with the first rotatable member, for fixing a toner image on a recording material, a frame supporting the second unit, a guiding member movable between a guiding position for guiding the recording material toward the nip and a retracted position where the guiding member is retracted from a space permitting demounting of the second unit from the frame, a cover member openable for exposing the space, and an interrelating mechanism configured to restore the guiding member, which is in the retracted position when the cover member is in an open position, to the guiding position in interrelation with movement of the cover member from the open position to a closed position.

According to another aspect, the present invention provides an image forming apparatus comprising an image forming portion configured to form a toner image a first unit including a first rotatable member, a second unit including a second rotatable member forming a nip, in cooperation with the first rotatable member, for feeding a recording material, a frame supporting the second unit, a guiding member movable between a guiding position for guiding the recording material toward the nip and a retracted position where the guiding member is retracted from a space permitting demounting of the second unit from the frame, a cover member openable for exposing the space, and an interrelating mechanism configured to restore the guiding member, which is in the retracted position when the cover member is in an open position, to the guiding position in interrelation with movement of the cover member from the open position to a closed position.

Further features of the present invention will become apparent from the following description of exemplary embodiments with reference to the attached drawings.

DESCRIPTION OF THE EMBODIMENTS

Embodiments of the present invention will be specifically described with reference to the drawings.

First Embodiment

Image Forming Apparatus

Figure 1:
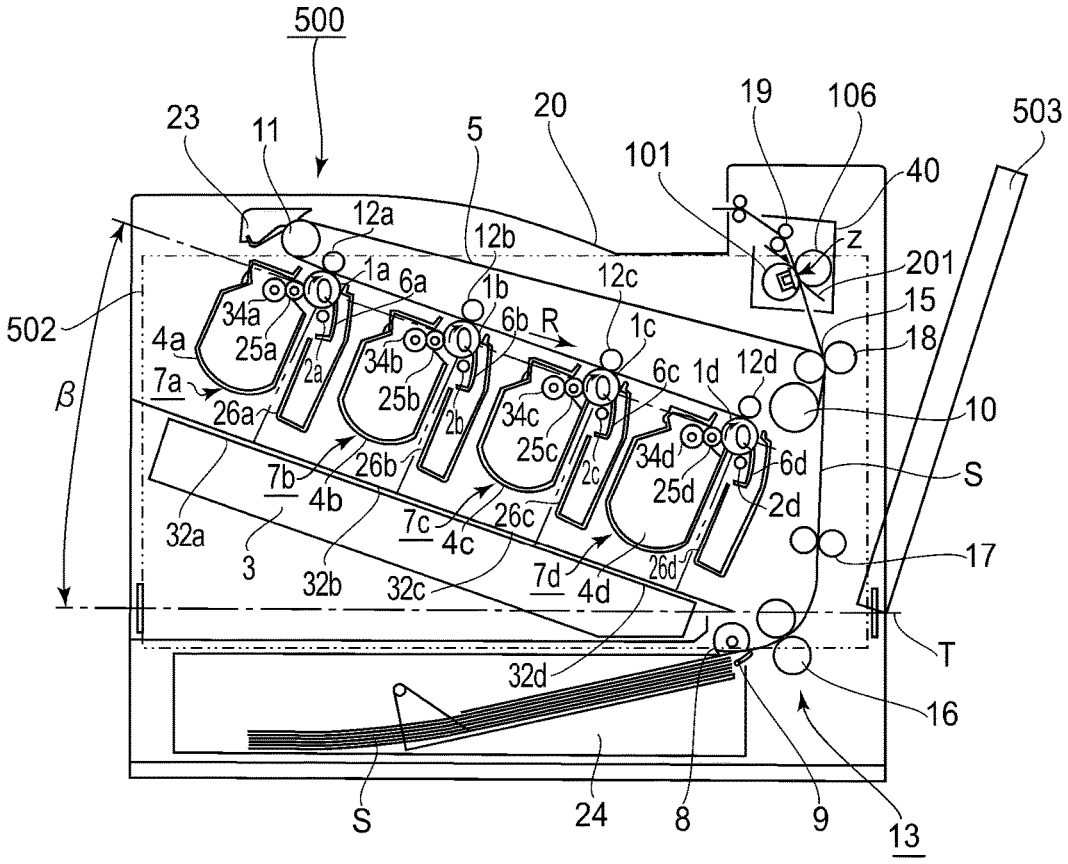
FIG. 1 is a sectional view for illustrating a schematic structure of an image forming apparatus in which a fixing device according to an embodiment is mounted.

An image forming apparatus 500 in this embodiment includes an image forming portion for forming a toner image on a recording material and a fixing portion (fixing device) for fixing the toner image, and a sectional view thereof is shown in FIG. 1. Four cartridges 7 (7*a* to 7*d*), which are juxtaposed obliquely and downwardly in the named order, include photosensitive drum units 26 (26*a* to 26*d*) including photosensitive drums 1 (la to 1*d*) as electrophotographic photosensitive members and developing units 4 (4*a* to 4*d*). Each of the cartridges 7*a* to 7*d* is provided detachably mountable to a main assembly of the image forming apparatus.

The photosensitive drums 1 are rotationally driven clockwisely (in a direction of arrow Q) in FIG. 1 by a driving member (not shown). At peripheries of the photosensitive drums 1, in the order of a rotational direction thereof, cleaning members 6 (6*a* to 6*d*), charging rollers 2 (2*a* to 2*d*), and the developing units 4 are provided.

The cleaning members 6 remove toner agents remaining on the photosensitive drums 1 after the toner images are transferred from the photosensitive drums 1 onto an intermediary transfer belt 5. The toner agents removed by the cleaning members 6 are collected in toner chambers in the photosensitive member units 26 (26*a* to 26*d*).

The charging rollers 2 electrically charge surfaces of the photosensitive drums 1 uniformly. After the surfaces of the photosensitive drums 1 are charged by the charging rollers 2, the surfaces of the photosensitive drums 1 are exposed to laser light from a scanner unit (exposure means) 3 through unit openings 32 (32*a* to 32*d*). As a result, electrostatic latent images are formed on the surfaces of the photosensitive drums 1. In this embodiment, the scanner unit 3 is disposed below the cartridges 7.

The developing units 4 supply the toner agents to the electrostatic latent images formed on the photosensitive drums 1 and develop the electrostatic latent images into the toner images. The developing units 4 include developing rollers 25 (25*a* to 25*d*) for supplying the toner agents to the surfaces of the photosensitive drums 1 in contact with the photosensitive drums 1 and supplying rollers 34 (34*a* to 34*d*) for supplying the toner agents to the surfaces of the developing rollers 25 in contact with the developing rollers 25.

When the image is formed on a recording material S, first, the electrostatic latent images formed on the surfaces of the photosensitive drums 1 by the scanner unit 3 are developed into the toner images by the cartridges 7, and then are transferred onto the intermediary transfer belt 5. The intermediary transfer belt 5 is stretched by a driving roller 10 and a tension roller 11 and is driven in an arrow R direction in FIG. 1. Inside the intermediary transfer belt 5, primary transfer rollers 12 (12*a* to 12*d*) are provided opposed to the photosensitive drums 1, and to the primary transfer rollers 12, transfer biases are applied by unshown bias applying means.

As regards the transfer biases, for example, in a case in which negatively charged toner agents are used, by applying positive biases to the primary transfer rollers 12, the toner images are successively transferred onto the intermediary transfer belt 5. Then, the four color toner images are fed to a secondary transfer portion 15 in a state in which four color toner images are superposed on the intermediary transfer belt 5. At this time, the toner agents remaining on the intermediary transfer belt 5 after the secondary transfer onto the recording material S are removed by a transfer belt cleaning device 23, and the removed toner agents pass through a residual (waste) toner feeding path (not shown) and are collected by a residual (waste) toner collecting container (not shown).

On the other hand, in sychronism with the image forming operation described above, the recording material S is fed toward the secondary transfer portion 15 by a feeding mechanism including a feeding device 13, a registration roller pair 17, and the like. The feeding device 13 includes a feeding cassette 24 for accommodating a plurality of recording materials S, a feeding roller 8, and a feeding roller pair 16 for feeding the fed recording material S. The feeding cassette 24 is detachably mountable to the image forming apparatus 500, and a user pulls out the feeding cassette 24 and demounts the feeding cassette 24 from the image forming apparatus 500, and then sets the recording materials S in the feeding cassette 24 and inserts the feeding cassette 24 into the image forming apparatus 500, so that supply of the recording materials S can be completed.

Of the recording materials S accommodated in the feeding cassette 24, the recording material S located in an uppermost portion is separated one by one by press-contact of the feeding roller 8 and a separation pad 9 with rotation of the feeding roller 8 (friction separation type), and then is fed. The recording material S fed from the feeding device 13 is fed to the secondary transfer portion 15 by the registration roller pair 17. At the secondary transfer portion 15, by applying a positive bias to a secondary transfer roller 18, it is possible to secondary-transfer the four color toner images from the intermediary transfer belt 5 onto the fed recording material S.

Then, the recording material S is fed from the secondary transfer portion 15 to a fixing device 40, in which heat and pressure are applied to the images transferred on the recording material S, so that the images are fixed on the recording material S. Thereafter, the recording material S on which the toner images are fixed is discharged onto a discharge tray 20 by a discharging roller pair 19.

Fixing Device

Figure 2:
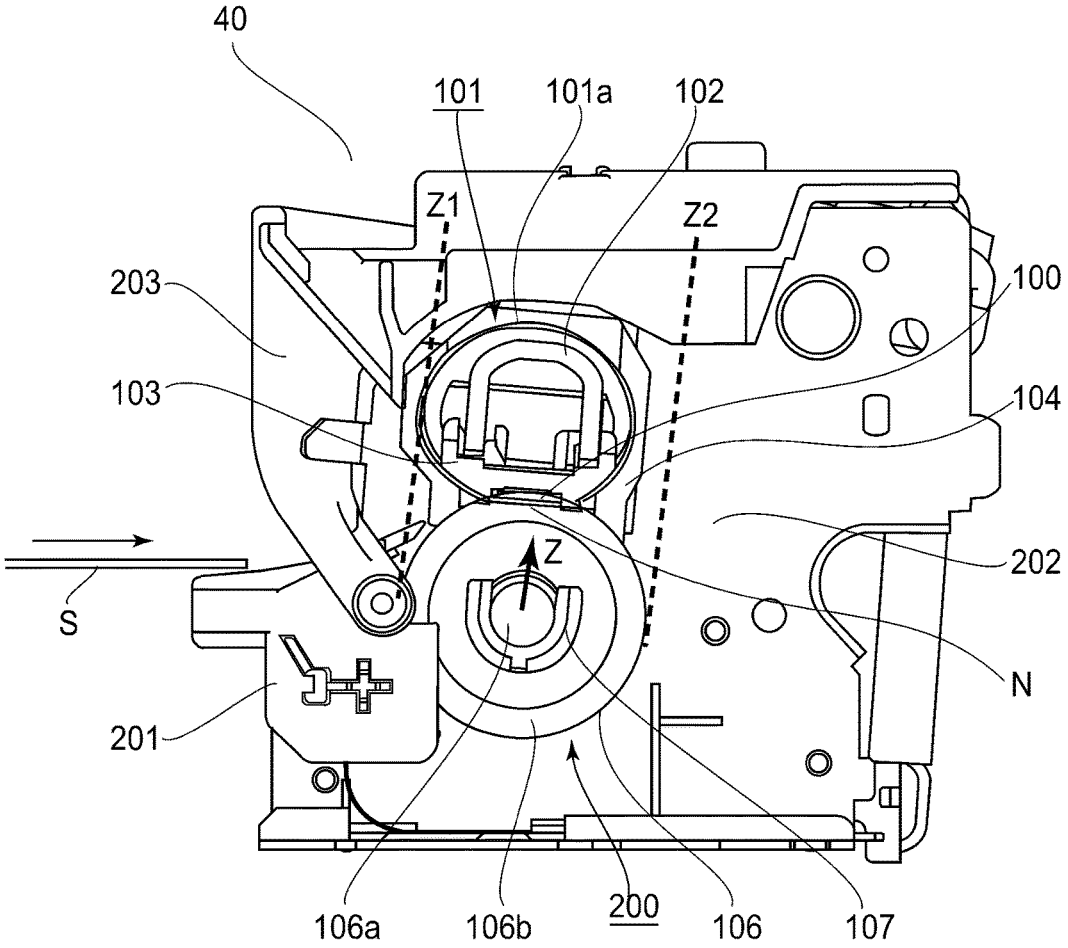
FIG. 2 is a sectional view for illustrating a schematic structure of the fixing device in the embodiment.

Next, the fixing device 40 will be described specifically using FIG. 2. Incidentally, a longitudinal direction described below refers to a direction perpendicular to the recording material feeding direction in a plane parallel to a recording material feeding surface. The fixing device 40 is of a film heating type and includes a first fixing unit (heating unit, first unit) 101 including a cylindrical fixing film 101*a* as a fixing member. Further, the fixing device 40 includes a second fixing unit (pressing unit, second unit) 200 including a pressing roller 106 that is a pressing member for forming a nip N for nipping and feeding the recording material S in a state in which the pressing roller 106 opposes the fixing film 101*a* and is heated together with the heating unit 101.

In this embodiment, the heating unit 101 includes a ceramic heater 100 as a heating member, and the heater 100 functions as a back-up member and forms a nip N between the fixing film 101*a* and the pressing roller 106.

Figure 3:
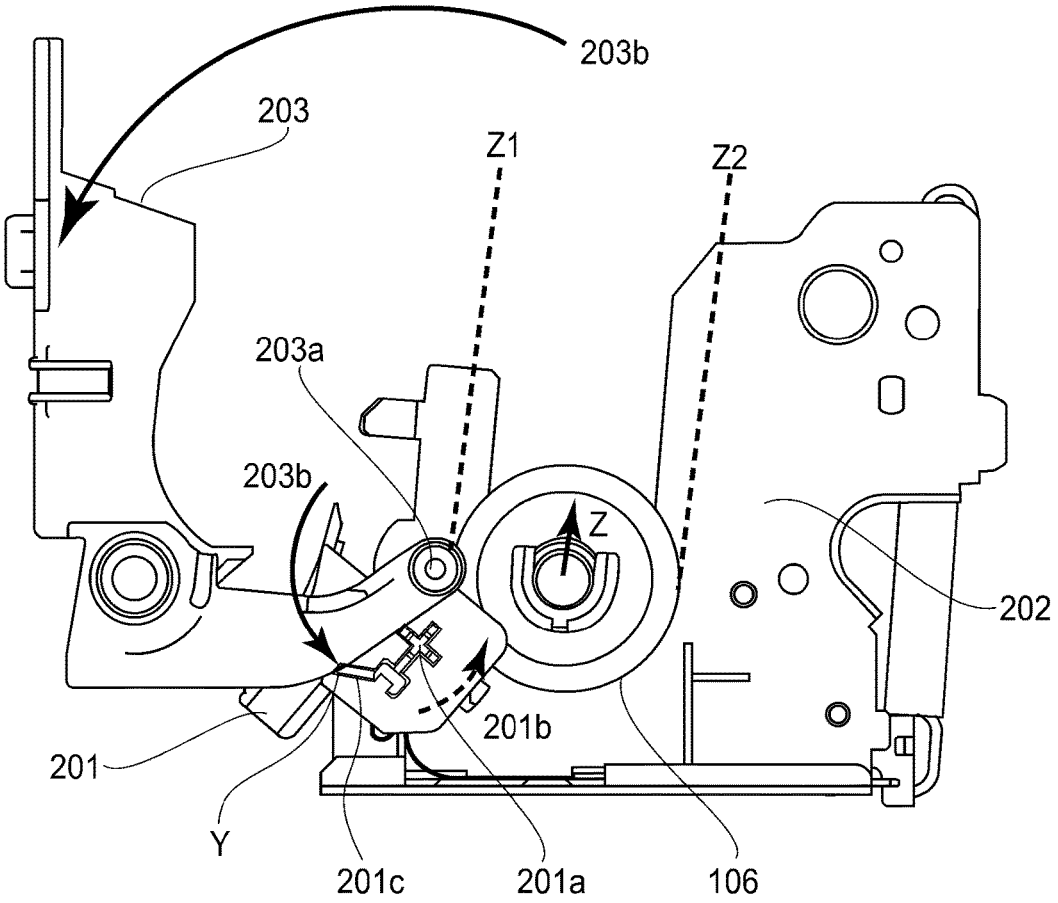
FIG. 3 is a sectional view showing a state when a pressing roller of the fixing device in the embodiment is demounted.

The fixing device 40 further includes a supporting member 103 for regulating an orbit of the fixing film 101*a*, a fixing flange 104 for regulating an end portion of the fixing film 101*a*, and a pressing stay 102 provided inside the fixing film 101*a* in order to ensure strength of the supporting member 103. Further, the fixing device 40 includes an entrance guide 201 as a guiding member for guiding the discharged and fed recording material S to the nip N and includes an openable cover 203 as an openable cover member. The openable cover 203 is assembled to a side plate 202, as shown in FIGS. 2 and 3.

The openable cover 203 is provided for the purpose of heat-insulating the fixing film 101*a* at a closed position and of ensuring strength of the fixing device 40. Further, as described later, a space permitting demounting of the second fixing unit 200 from the side plate 202 as a frame at an open position can be exposed. This openable cover 203 is provided relative to the fixing device 40 and is provided separately from a door (second cover member) 502 that is opened and closed when the cartridge 7 is mounted in and demounted from the image forming apparatus main assembly and separately from a door (second cover member) 503 that is opened and closed when the fixing device 40 is mounted in and demounted from the image forming apparatus main assembly. The doors 502 and 503 are provided on the image forming apparatus main assembly. Constituent members of the fixing device 40 will be described.

(1) Heating Member

The heater 100, as a heating member, has a basic structure including an elongated thin plate-like ceramic substrate and an energization heat generation resistor layer formed on a surface of the substrate, and is a low thermal capacity heater that increases in temperature with an abrupt temperature rise characteristic, as a whole, by energization to the heat generation resistor layer. This heater 100 is engaged in and is supported by an engaging groove provided on a lower surface of the fixing film supporting member 103 along the longitudinal direction of the fixing film supporting member 103.

(2) First Rotatable Member

The fixing film 101*a*, as an endless belt that is a first rotatable member, is a cylindrical heat-resistant member for conducting heat to the recording material S and is externally fitted around the fixing film supporting member 103. The fixing film 101*a* is a film having a four-layer composite structure consisting of a parting layer, an elastic layer, a base layer, and an inner surface coating layer. As a material of the parting layer, a fluorine-containing resin material of 100 μm or less, preferably 20 μm to 70 μm in thickness can be used. As the fluorine-containing resin material, polytetrafluoroethylene (PTFE), or perfluoroalkoxy alkane (PFA), and the like, can be cited, for example. Further, as a material of the elastic layer, for reducing thermal capacity, a rubber material of 1000 μm or less, preferably 500 μm or less in thickness can be used, and for example, a silicone rubber, a fluorine-containing rubber, and the like, can be cited.

Further, as a material of the base layer, a heat-resistant material of 100 μm or less, preferably 50 μm or less and 20 μm or more in thickness can be used, and for example, a metallic film of stainless steel (SUS), nickel, or the like, and a resin material, such as polyimide can be used. Further, the inner surface coating layer is a resin layer having a heat-resistant property, and as a material thereof, polyimide, polyimideamide, polyether ether ketone (PEEK), PTFE, fluorinated ethylene propylene (FEP), PEA, and the like, can be cited, for example.

(3) Second Rotatable Member

As the second rotatable member opposing the fixing film 101*a*, the pressing roller 106, which is the pressing member, is rotationally driven by a driving means via an unshown gear attached to a longitudinal end portion thereof, so that the fixing film 101*a* is rotated by the pressing roller 106.

This pressing roller 106 includes a metal core 106*a* and a heat-resistant elastic material layer 106*b*, which is molded and coated in a roller shape around the metal core 106*a* so as to be concentrically integral with the metal core 106*a*, and which is formed with a silicone rubber, a fluorine-containing rubber, a fluorine-containing resin, or the like. As a surface layer, a parting layer is provided, and as a material of the parting layer, a material having good parting and heat-resistant properties, such as fluorine-containing resin, a silicone resin, a fluorosilicone rubber, a fluorine-containing rubber, a silicone rubber, PFA, PTFE, FEP, and the like, can be selected.

At both end portions of the metal core 106*a* with respect to the longitudinal direction, bearing members 107, formed of a heat-resistant resin material, such as PEEK, polyphenylene sulfide (PPS), or a liquid crystal polymer (LCP), are mounted, and are disposed by being held by the side plates 202. Further, the pressing unit including the pressing roller 106 is supported by the side plates 202 so as to be demountable (described specifically later).

(4) Fixing Film Supporting Member

The fixing film supporting member 103 not only supports the fixing film 101*a* but also functioning as a press-contact member for holding the heater 100 and for causing the heater 100 to press-contact the nip.

As a material of the fixing film supporting member 103, a material having good insulating and heat-resistant properties, such as a phenolic resin, a polyimide resin, polyamide resin, a polyamideimide resin, a PEEK resin, a polyether sulfones (PIES) resin, a PPS resin, a PFA resin, a PTFE resin, an LCP resin, or the like, is used.

The fixing film supporting member 103 is provided with an engaging groove so that the fixing film supporting member 103 can support the heater 100 and causes the fixing film 101*a* to press-contact the pressing roller 106, so that the nip N is formed.

(5) Pressing Stay

The pressing stay 102 imparts longitudinal strength to the fixing film supporting member 103 and rectifies the fixing film supporting member 103 by being pressed against a back surface of the fixing film supporting member 103 made of a relatively soft resin.

(6) Fixing Flanges

The fixing flanges 104 are engaged with both longitudinal ends of the pressing stay 102, and not only guide rotation of the fixing film 101*a*, as well as prevent slip-out of the fixing film 101*a* in the longitudinal direction. The fixing flanges 104 are engaged and held by the side plates 202 as frames.

Exchange of Pressing Unit

Next, an exchange procedure of the pressing unit (second unit) 200 including the pressing roller 106 in this embodiment will be described using FIGS. 2, 3, and 4. In FIGS. 1 and 2, in a state in which the fixing film 101*a* is removed in advance, the pressing roller 106 is pulled out (demounted) along the side plate 202 in an arrow Z direction (as a demounting direction of the pressing unit 200, in a direction approaching a position where the heating unit 101 is provided).

At that time, loci drawn when the pressing roller 106 is exchanged are represented by a broken line Z1 and a broken line Z2. In order to stably guide the recording material S into the fixing nip, a free end of the entrance guide 201 on the nip side is close to the nip, and, therefore, the locus Z1 interferes with the entrance guide 201.

Therefore, in this embodiment, the entrance guide 201 has a constitution in which the entrance guide 201 is movable between a guiding position, in which the entrance guide 201 guides the recording material S, and a retracted position, in which the pressing unit 200 is retracted from a space permitting demounting of the pressing unit 200. When the pressing unit 200 is demounted from the side plates 202, by moving the entrance guide 201 to the retracted position, the pressing unit 200 can be demounted without interfering with the entrance guide 201. Further, in this embodiment, in order to prevent forgetfulness to return the entrance guide 201 to the guiding position when the pressing unit 200 is returned to the side plates 202, the following interrelating mechanism interrelated with a closing operation of the openable cover 203 is provided. That is, in a case in which the entrance guide 201 is in the retracted position in a state in which the openable cover 203 is in the open position, the entrance guide 201 is restored to the guiding position in interrelation with movement of the openable cover 203 from the open position to the closed position. Incidentally, a method of moving the entrance guide 201 to the retracted position in order to demount the pressing unit 200 may be a method in which the movement of the entrance guide 201 is interrelated with the opening operation of the openable cover 203 by the interrelating mechanism, as in this embodiment, and may also be another method. For example, a constitution in which the entrance guide 201 is moved to the retracted position by a hand of an operator, or a constitution in which the entrance guide 201 is automatically moved to the retracted position by drive of a motor, or the like, may also be employed.

As a preferred constitution, in this embodiment, the following interrelating mechanism interrelated with opening and closing of the openable cover 203 is employed. That is, not only is the entrance guide 201 retracted from the space, permitting demounting of the pressing unit, in interrelation with movement of the openable cover 203 from the closed position to the open position, but also the entrance guide 201 is restored to the guiding position in interrelation with movement of the openable cover 203 from the open position to the closed position. As a result, the operator is not required to independently move the openable cover 203 and the entrance guide 201 in order to demount the pressing unit 200, and, therefore, an operation during demounting of the pressing unit 200 is facilitated.

FIG. 3 is a sectional view showing a state in which the pressing roller 106 in this embodiment is demounted in a state that the fixing film 101*a* is removed in advance. In order to access the pressing roller 106, there is a need to demount the openable cover 203 that is thermally insulating the fixing device 40. The openable cover 203 includes a rotation shaft 203*a* as a first supporting point and is rotatable in a direction of an arrow 203*b*.

Next, motion of the entrance guide 201 will be described. The entrance guide 201 includes a rotation shaft 201*a* as a second supporting point and is rotatable in a direction of an arrow 201*b*. Here, the entrance guide 201 includes a projected portion 201*c* as a contact portion (a part of the above-described interrelating mechanism interrelated with the opening and closing of the openable cover 203) contacting the openable cover 203. The projected portion 201*c* is designed to contact the openable cover 203 at a point Y when the openable cover 203 is rotated.

For this reason, in interrelation with the motion such that the openable cover 203 rotates about the rotation shaft 203*a* as the supporting point in the arrow 203*b* direction, the entrance guide 201 rotates about the rotation shaft 201*a* as the supporting point in the arrow 201*b* direction (i.e., the entrance guide is retracted from an original first position to a second position). In a projection region as viewed from the demounting direction of the pressing roller 106, a downstream region of the entrance guide 201 with respect to a recording material feeding direction overlaps with the pressing roller 106 at the first position, but does not overlap with the pressing roller 106 at the second position.

Thus, the entrance guide 201 is rotated (retracted) by the motion such that the openable cover 203 is required to be always opened and closed in order to access the pressing roller 106. As described later, the entrance guide 201 is urged toward the guiding position by a guide urging member 204. In a state in which the openable cover 203 is in the closed position, however, a constitution in which, by a weight of the openable cover 203, the entrance guide 201 is maintained in the retracted position against an urging force of the guide urging member 204. As a result, on the broken line Z1, which is the locus drawn when the pressing roller 106 is exchanged, it is possible to avoid inference between the entrance guide 201 and the pressing roller 106.

Figure 4:
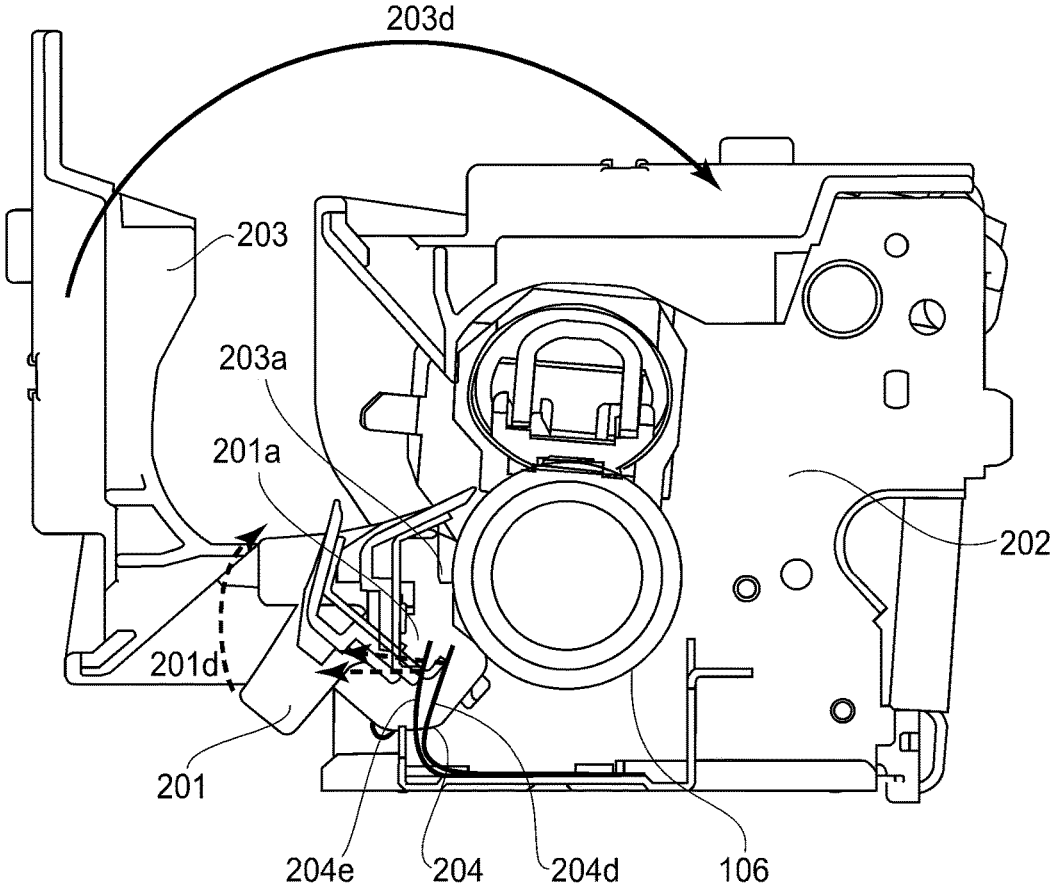
FIG. 4 is a sectional view showing an operation in which the pressing roller of the fixing device is exchanged and an openable cover is closed.

FIG. 4 is a sectional view showing an operation of closing the openable cover 203 in a state in which the pressing roller 106 is exchanged and then the heating unit 101 is disposed. The entrance guide 201 always receives a force from the guide urging member (restoring member, spring member) 204 as a part of the above-described interrelating mechanism interrelated with the opening and closing of the openable cover 203. The guide urging member 204 is a component for exerting the force on the entrance guide 201 in order to determine an attitude of the entrance guide 201, and the attitude of the entrance guide 201 on which the force is exerted is determined as an abutting attitude against unshown positioning portions provided on the side plates 202. Such a guide urging member 204 is constituted by a thin plate of SUS in this embodiment.

When the openable cover 203 is closed, at the above-described point Y, a contacting force of the openable cover 203 to the projected portion 201*c* of the entrance guide 201 is eliminated. For this reason, the guide urging member 204 deforms from a state 204*d* to a state 204*e*, so that the entrance guide 201, on which the force is exerted, is automatically returned (restored) to a normal position (first position) and thus, the attitude thereof is fixed.

In this embodiment, as described above, a constitution in which, depending on a change in position from the closed position to the open position of the openable cover 203, the openable cover 203 is always opened before the pressing roller 106 is demounted, and the entrance guide 201 is moved from the normal position (first position) to the retracted position (second position) is employed. Further, a constitution in which, when the openable cover 203 is returned to a normal position (closed position), the force is exerted on the entrance guide 201 in the rotational direction by the guide urging member 204 so that the entrance guide 201 is automatically returned to the normal position (first position), may be employed.

As a result, without providing the photosensor, as disclosed in JP-A No. 2011-22536, it becomes possible to achieve prevention of the forgetfulness to close the entrance guide inexpensively and easily. In this embodiment, the reason why the constitution using the interrelating mechanism, rather than a constitution in which the entrance guide 201 is fixed to the openable cover 203 by fastening with screws, or the like, is employed is as follows. That is because the entrance guide 201 can also be moved alone without being restricted to interrelation with the opening and closing operation of the openable cover 203. That is, even in a case in which the openable cover 203 is not moved, the entrance guide 201 is movable between the guiding position and the retracted position. For example, in a state in which the openable cover 203 is kept closed, the operator can move the entrance guide 201 against the urging force of the guide urging member 204. As a result, for example, in a case in which jammed paper, which is not readily removed, exists in the fixing device, the operator can move only the entrance guide 201 in order to remove the jammed paper.

In the above-described embodiment, a preferred embodiment of the present invention was described, but the present invention is not limited thereto, and can also be variously modified or changed within the scope of thereof. Further, constitutions and arrangements in the above-described embodiment may also be appropriately selected and combined with each other. Further, dimensions, materials, shapes and the relative arrangement of constituent parts described in the above-described embodiment should be appropriately changed depending on structures and various conditions of the devices (apparatuses) to which the present invention is applied.

Modified Embodiment 1

In the above-described embodiment, as the rotatable member in the first fixing unit, the endless belt was used, but a fixing roller may also be used. Further, as the opposing member in the second fixing unit, the pressing roller was used, but the endless belt may also be used. Further, the endless belt may also be used as both the rotatable member and the opposing member.

Further, in the above-described embodiment, a case in which the endless belt as the rotatable member is pressed by the pressing roller as the opposing member was described. The present invention is not limited thereto, however, and is similarly applicable to a case in which the opposing member is pressed by the endless belt as the rotatable fixing member.

Modified Embodiment 2

In the above-described embodiment, the fixing device for fixing the unfixed toner image on the sheet was described, but the present invention is not limited thereto, and may also be applicable to a device for heat-pressing a toner image, temporarily fixed on a sheet, in order to improve glossiness of an image.

Modified Embodiment 3

In the above-described embodiment, as the recording material, the recording paper was described, but the recording material in the present invention is not limited to the paper. In general, the recording material is a sheet-shaped member on which the toner image is formed by the image forming apparatus and includes, for example, regular or irregular members of plain paper, thick paper, thin paper, an envelope, a post-card, a seal, a resin sheet, an overhead projector (OHP) sheet, glossy paper, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a first unit including a first rotatable member;

a second unit including a second rotatable member forming a nip, in cooperation with said first rotatable member, for fixing a toner image on a recording material;

a frame supporting said second unit;

a guiding member provided upstream of the nip with respect to a rotational direction of said second rotatable member, and movable between a guiding position for guiding the recording material toward the nip, and a retracted position in which said guiding member is retracted from a space permitting demounting of said second unit from said frame;

a cover member openable to an open position for exposing the space, and configured to move to a closed position; and an interrelating mechanism configured to restore said guiding member, which is in the retracted position when said cover member is in the open position, to the guiding position in interrelation with movement of said cover member from the open position to the closed position.

2. The fixing device according to claim 1, wherein said interrelating mechanism moves said guiding member to the retracted position in interrelation with movement of said cover member from the closed position to the open position.

3. The fixing device according to claim 2, wherein said interrelating mechanism includes a contact portion contacting said cover member with the movement of said cover member from the closed position to the open position, said contact portion being provided on said guiding member.

4. The fixing device according to claim 1, wherein a demounting direction of said second unit from said frame is a direction in which said second unit approaches a position at which said first unit has already been demounted.

5. The fixing device according to claim 1, wherein the space is exposed by demounting said first unit.

6. The fixing device according to claim 1, wherein, in a projection plane, when said guiding member, being in the guiding position, is viewed in a demounting direction of said second unit, a part of said guiding member and a part of said second rotatable member overlap with each other.

7. The fixing device according to claim 1, wherein said guiding member is movable between the guiding position and the retracted position without movement of said cover member.

8. The fixing device according to claim 1, wherein said interrelating mechanism includes a spring member configured to urge said cover member from the open position toward the closed position.

9. The fixing device according to claim 1, wherein said frame detachably supports said first unit.

10. The fixing device according to claim 1, wherein said cover member is rotatable about a first supporting point between the closed position and the open position, and said interrelating mechanism retracts said guiding member depending on a change in position of said cover member from the closed position to the open position.

11. The fixing device according to claim 10, wherein said guiding member is rotatable about a second supporting point, different from the first supporting point, and is retracted by being rotated about the second supporting point by the interrelating mechanism.

12. The fixing device according to claim 1, wherein said first rotatable member contacts an unfixed toner image in the nip.

13. An image forming apparatus comprising:

an image forming portion configured to form a toner image;

a first unit including a first rotatable member;

a second unit including a second rotatable member forming a nip for feeding a recording material in cooperation with said first rotatable member;

a frame supporting said second unit;

a guiding member provided upstream of the nip with respect to a rotational direction of said second rotatable member, and movable between a guiding position for guiding the recording material toward the nip, and a retracted position in which said guiding member is retracted from a space permitting demounting of said second unit from said frame;

a cover member openable to an open position for exposing the space, and configured to move to a closed position; and an interrelating mechanism configured to restore said guiding member, which is in the retracted position when said cover member is in the open position, to the guiding position in interrelation with movement of said cover member from the open position to the closed position.

14. The image forming apparatus according to claim 13, further comprising a second cover member openable to an open position for exposing a space permitting demounting, from a main assembly of said image forming apparatus, of a unit including said second unit, said frame, said guiding member, said cover member, and said interrelating mechanism, and configured to close to a closed position.

15. The image forming apparatus according to claim 13, further comprising a second cover member openable to an open position for exposing a space permitting demounting of said image forming portion from a main assembly of said image forming apparatus, and configured to close to a closed position, wherein said first rotatable member and said second rotatable member fix the toner image on the recording material in the nip.

16. The image forming apparatus according to claim 13, wherein said interrelating mechanism moves said guiding member to the retracted position in interrelation with movement of said cover member from the closed position to the open position.

17. The image forming apparatus according to claim 13, wherein a demounting direction of said second unit from said frame is a direction in which said second unit approaches a position at which said first unit has already been demounted.

18. The image forming apparatus according to claim 13, wherein the space is exposed by demounting said first unit.

19. The image forming apparatus according to claim 13, wherein, in a projection plane, when said guiding member, being in the guiding position, is viewed in a demounting direction of said second unit, a part of said guiding member and a part of said second rotatable member overlap with each other.

20. The image forming apparatus according to claim 13, wherein said frame detachably supports said first unit.

* * * * *